US006596951B1

(12) United States Patent
Cusack

(10) Patent No.: US 6,596,951 B1
(45) Date of Patent: Jul. 22, 2003

(54) SNAP DISC PRESSURE SWITCH

(75) Inventor: Jon B. Cusack, Holland, MI (US)

(73) Assignee: Sherwood-Templeton Coal Company, Inc., Indianapolis, IN (US)

( * ) Notice: Subject to any disclaimer, the term of this patent is extended or adjusted under 35 U.S.C. 154(b) by 0 days.

(21) Appl. No.: 10/147,794

(22) Filed: May 17, 2002

(51) Int. Cl.[7] ..... H01H 35/40
(52) U.S. Cl. ..... 200/83 P; 200/83 N
(58) Field of Search ..... 200/61.6, 61.25, 200/81 R, 83 F, 83 P, 83 N, 83 V

(56) References Cited

U.S. PATENT DOCUMENTS

| | | | | |
|---|---|---|---|---|
| 3,584,168 A | * | 6/1971 | Halpert et al. | 200/83 R |
| 4,190,752 A | | 2/1980 | Rogers | 200/81 |
| 4,243,858 A | | 1/1981 | Place | 200/83 |
| 4,272,660 A | | 6/1981 | Mayer et al. | 200/83 |
| 4,297,552 A | * | 10/1981 | Lauritsen et al. | 200/83 P |
| 4,820,890 A | | 4/1989 | Tamura et al. | 200/81 |
| 5,149,927 A | | 9/1992 | Stahly | 200/83 |
| 5,225,643 A | | 7/1993 | Marchant | 200/834 |
| 5,300,741 A | | 4/1994 | Hogue et al. | 200/83 |
| 5,432,310 A | | 7/1995 | Stoeger | 200/82 |
| 5,508,483 A | | 4/1996 | Czarn et al. | 200/83 |
| 5,586,386 A | | 12/1996 | Morin | 29/622 |
| 5,814,779 A | | 9/1998 | Verras et al. | 200/83 |
| 5,917,164 A | | 6/1999 | Sasaki | 200/83 |
| 6,091,034 A | | 7/2000 | Glassburn et al. | 200/83 |

FOREIGN PATENT DOCUMENTS

| | | |
|---|---|---|
| DE | 3819458 | * 12/1989 |
| JP | 01283726 | * 11/1989 |

* cited by examiner

*Primary Examiner*—Karl D. Easthom
*Assistant Examiner*—Lisa N Klaus
(74) *Attorney, Agent, or Firm*—Price, Heneveld, Cooper, DeWitt & Litton

(57) ABSTRACT

A pressure switch is provided for opening and closing an electrical switch based on a pressure set point. The pressure switch includes a housing having walls defining a fluid chamber adapted to receive a fluid. The pressure switch also includes a snap disc having a front surface in pressure communication with the fluid chamber and responsive to switch states between first and second shapes. The pressure switch further includes a circuit board having printed circuitry and first and second electrical terminals. The snap disc has a rear conductive surface that forms a closed circuit between the first and second terminals when in the first shape and forms an open circuit when in the second shape.

23 Claims, 4 Drawing Sheets

SNAP DISC PRESSURE SWITCH

BACKGROUND OF THE INVENTION

The present invention generally relates to pressure sensitive electrical switching devices and, more particularly, to pressure switches employing snap discs that change shape due to a snapping action caused by pressure applied thereto.

Pressure switches are widely used for controlling electrically operated devices by switching an electrical contact between open and closed circuit positions based on a preset fluid pressure threshold. For example, pressure switches are installed in fluid communication with the outlet side of a water pump in a heated spa/hot tub to monitor the water pressure. If the water pressure drops below a preset pressure threshold, such as may occur due to a potential water pump failure, the pressure switch changes state to disable power to an electrical heater to prevent further heating. Pressure switches are also employed in the exhaust passage of heating systems to shut off a furnace when the exhaust pressure drops below a preset pressure threshold. In addition to sensing positive pressure differentials, snap disc pressure switches could be configured to be responsive to negative pressure differentials, such as to operate as a vacuum switch.

Snap disc pressure switches typically employ a snap disc disposed in a fluid housing such that the snap disc is sensitive to the pressure of a fluid. The snap disc has a convex surface that changes shape to an inverted configuration due to a snap action when the applied fluid pressure reaches a preset pressure threshold. Many conventional snap disc pressure switches also include a movable connecting member and a movable contact arm engaged with the snap disc such that when the snap disc changes configurations between first and second shapes, the movable contact is moved between open and closed contact positions.

While some commercially available snap discs offer high reliability, upwards of several million cycles, prior known pressure switches utilizing snap discs are generally configured with several moving components, including a pressure-to-force converter, a movable contact arm, and a connecting member coupled between the snap disc and the contact arm. The presence of several moving components and the extended travel of such components increases the susceptibility of a component failure and increases complexity of the assembly of the pressure switch. Additionally, many prior known pressure switches are not easily adjustable to select the pressure threshold set point.

Accordingly, it is therefore desirable to provide for a snap disc pressure switch that offers high reliability, is easy to assembly, and is cost affordable. It is also desirable to provide a snap disc pressure switch that has minimal moving components. It is further desirable to provide a snap disc pressure switch that is easily adjustable to set the pressure set point at which the switch changes state.

SUMMARY OF THE INVENTION

In accordance with the teachings of the present invention, a pressure switch is provided for opening and closing an electrical connection based on a pressure set point. According to one aspect of the present invention, the pressure switch includes a housing comprising walls defining a fluid chamber adapted to receive a fluid. The pressure switch also includes a snap disc having a front surface in pressure communication with the fluid chamber and responsive to switching states between first and second shapes based on a pressure set point, and an electrically conductive rear surface. The pressure switch further includes a circuit board comprising first and second electrical terminals. The snap disc forms a closed circuit between the first and second terminals when the snap disc is in the first shape and forms an open circuit when the snap disc is in the second shape.

According to another aspect of the present invention, the pressure switch includes a housing having walls defining a fluid chamber adapted to receive a fluid, and a snap disc having a front surface in pressure communication with the fluid chamber. The snap disc is responsive to switch states between first and second shapes based on a pressure set point, and includes an electrically conductive rear surface. The pressure switch further includes a first electrical terminal and a second electrical terminal. The first and second electrical terminals form a closed circuit with the conductive rear surface of the snap disc when in a first shape and form an open circuit when in a second shape. Accordingly, the pressure switch of the present invention employs a snap disc that offers high reliability and requires minimal moving components.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 1:
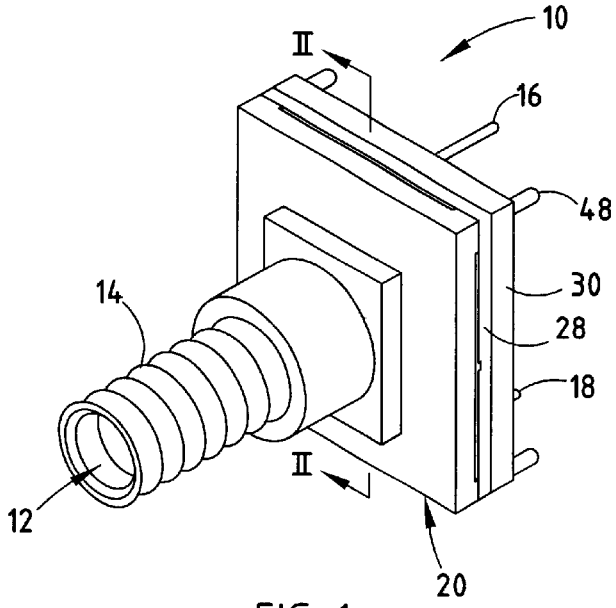
FIG. 1 is a perspective view of a pressure switch embodying the present invention according to a first embodiment.
Figure 2:
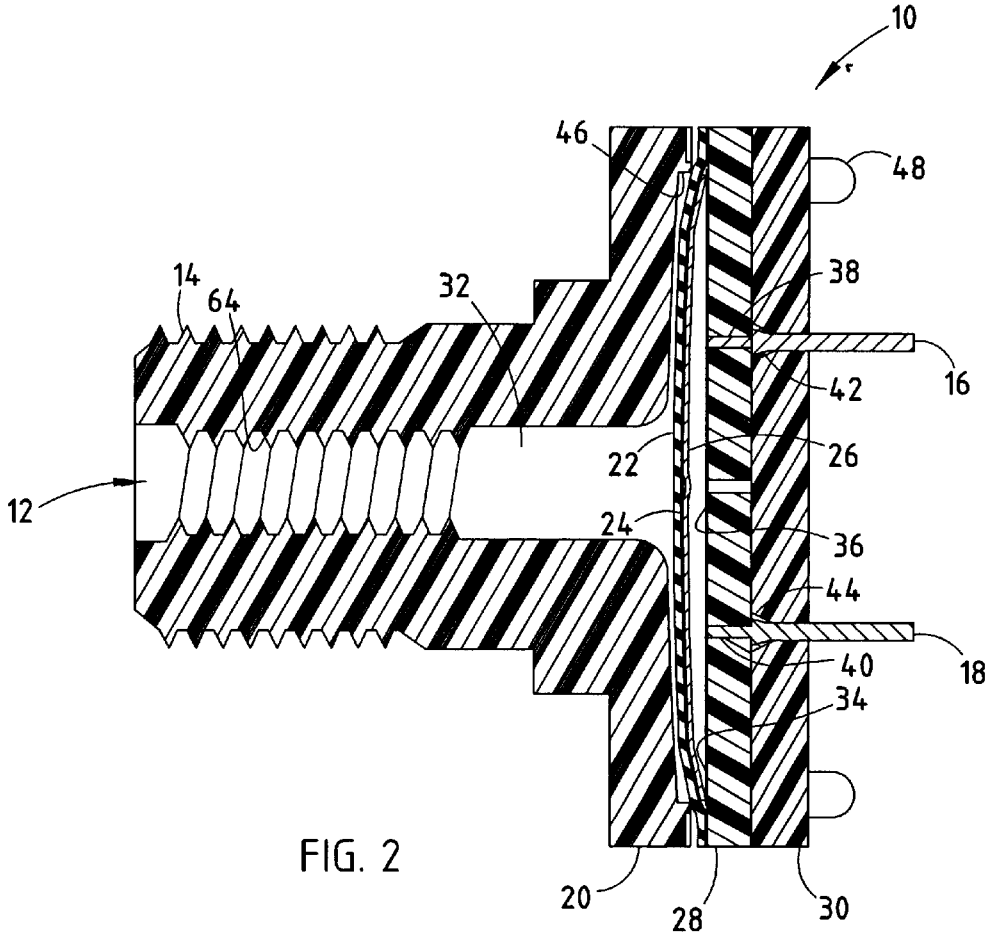
FIG. 2 is a cross-sectional view of the pressure switch taken through lines II—II of FIG. 1.
Figure 3:
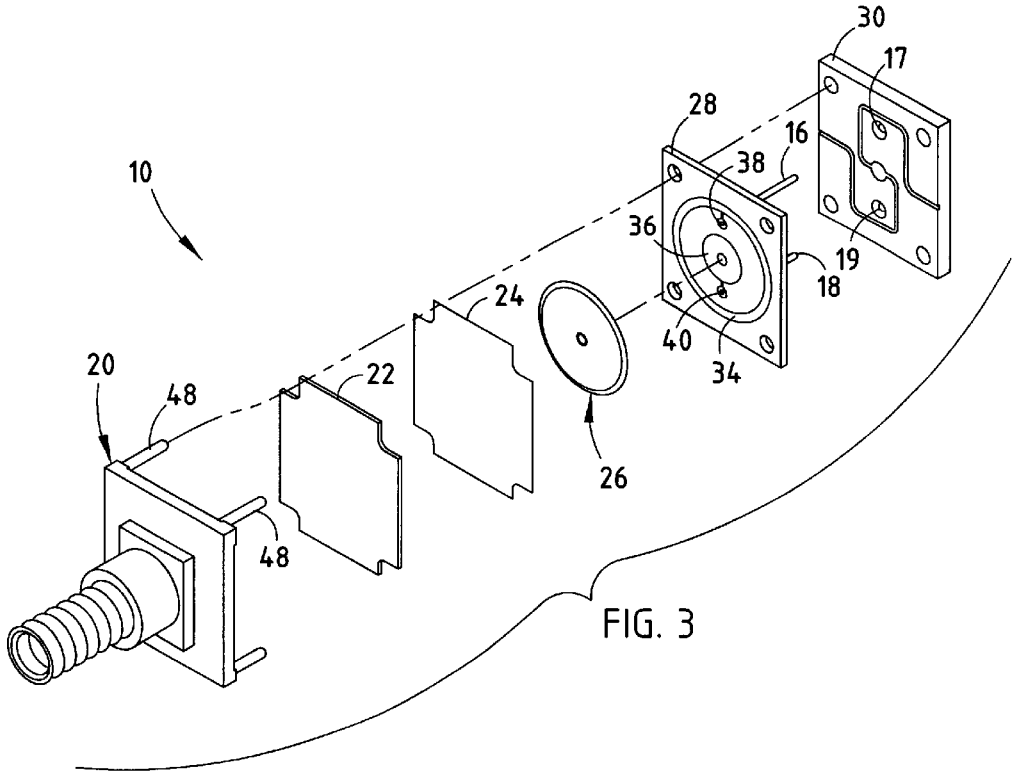
FIG. 3 is an exploded view of the pressure switch of FIG. 1.

Referring to FIGS. 1–3, a pressure switch 10 is illustrated according to a first embodiment for providing pressure sensitive electrical switching that changes an electrical output state based on the pressure of a fluid. The pressure switch 10 includes an inlet 12 defined by a fluid housing 20 adapted to be connected in fluid communication with a fluid, such as a liquid or gas. The fluid housing 20 generally includes a threaded outer male member 14 adapted to engage an internally threaded female receptacle (not shown) in a fluid container (not shown), such as a water heater line for a hot tub/spa, according to one example. The fluid housing 20 has internal walls defining a fluid chamber 32 for housing fluid received via inlet 12. Fluid housing 20 further includes an internally threaded female receptacle 64 for receiving a combination plug and spring as described later herein in connection with a second embodiment of the present invention.

The fluid housing 20 is preferably made of a non-conductive material, such as a polymeric material (e.g., plastic). Formed near the four rear corners of housing 20 are four stakes 48 extending through openings in the four corners of both a printed circuit board 28 and a back support member 30. The stakes 48 may be heat staked or otherwise fixedly attached on the rear surface of support member 30 to align and hold the individual components of the pressure switch 10 together.

Disposed between the printed circuit board 28 and fluid housing 20 is a snap disc 26 which is taped to the front surface of printed circuit board 28 via a sheet of adhesive tape 24. One example of an adhesive tape may include Mylar® film, which is commercially available from E.I. du Pont de Nemours and Company, Inc. The snap disc 26 is shaped to include a convex surface that changes shape to an inverted configuration due to a snap action when pressure applied to the front surface thereof reaches a preset pressure set point. When the fluid pressure applied to the front surface sufficiently drops, the snap disc 26 returns to its original non-inverted shape. The snap disc 26 has a conductive rear surface and may be made entirely of a conductive material, such as stainless steel. Snap disc 26 is adapted to engage conductive circuitry on the printed circuit board 28 to form either an open or a closed contact electrical connection as explained herein. Snap discs are widely known and commercially available. One example of a suitable snap disc may include Model No. P75600 commercially available from Snaptron Inc.

The snap disc 26 is seated within a recessed seat (cavity) 46 formed in the rear surface of fluid chamber 32. Disposed over the front surface of the sheet of adhesive tape 24 and snap disc 26 is a planar (flat) gasket 22 which forms a seal between the fluid chamber 32 and snap disc 26. Since the snap disc 26 is disposed within seat 46, the gasket 22 may be in the shape of a planar sheet that is flexible to form a seal and to transmit the fluid pressure within fluid chamber 32 to the front surface of snap disc 26. It should be appreciated that the gasket 22 is flexible and may be made of a neoprene or other suitable sealing material.

Figure 5:
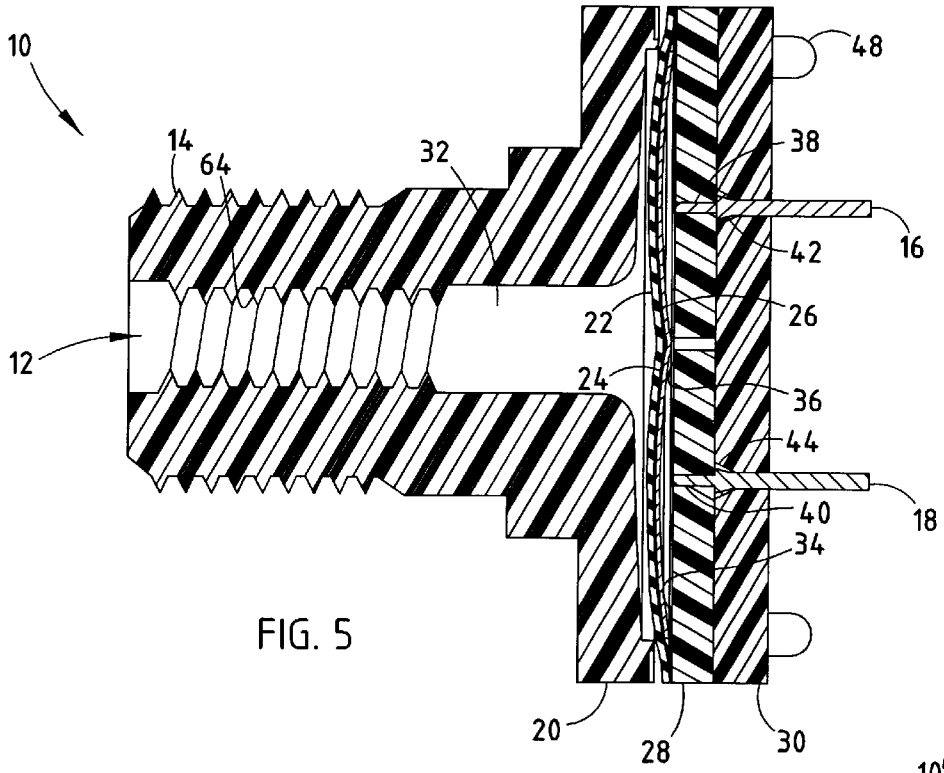
FIG. 5 is a cross-sectional view of the pressure switch showing the snap disc in a closed contact position.

The printed circuit board 28 includes electrically conductive circuitry formed on the front surface thereof including an outer ring-shaped printed circuit 34 and an inner circular printed circuit 36 centrally located in the center of circuit 34. The outer printed circuit 34 is electrically connected to a first electrical terminal 16 by way of a conductive via 38 extending through circuit board 28. The inner printed circuit 36 is electrically connected to a second electrical terminal 18 by way of conductive via 40 extending through the circuit board 28. Accordingly, an open circuit condition exists between electrical terminals 16 and 18 whenever the outer printed circuit 34 and inner printed circuit 36 are not electrically connected by way of the rear conductive surface of snap disc 26. When the snap disc 26 is configured in the normally open contact position as shown in FIG. 2, the rear conductive surface of snap disc 22 contacts the outer printed circuit 34 and is spaced from the inner printed circuit 36 to form an open circuit connection between electrical terminals 16 and 18. When the fluid pressure within fluid chamber 32 reaches the first preset pressure set point, the snap disc 26 changes shape to an inverted configuration as shown in FIG. 5 such that the rear conductive surface of the snap disc 22 simultaneously contacts both the outer printed circuit 34 and the inner printed circuit 36 to form a closed circuit electrical connection between electrical terminals 16 and 18. The snap disc 22 will remain in the closed contact position until the fluid pressure within fluid chamber 32 drops back below a second pressure set point threshold. The second pressure set point may be less than the first preset pressure set point threshold, thereby providing hysteresis. Accordingly, the snap disc 26 changes shape by way of a snapping action to either open circuit or close circuit the electrical connection between first and second terminals 16 and 18. The pressure switch 10 can therefore control the current flow between the terminals 16 and 18 which can control energization of an electrically powered device.

The snap disc 26 is attached to the front surface of printed circuit board 28 via the sheet of adhesive tape 24 which holds the outer peripheral edge of snap disc 26 in contact with outer printed circuit 34. When snap disc 26 changes the configuration between the first and second shapes, the outer peripheral edge of snap disc 26 moves radially and thus slidably engages the outer printed circuit 34. The sliding engagement between outer printed circuit 34 and snap disc 26 allows for snap disc 26 to invert and change shape. While tape 24 is shown and described herein in connection with attaching snap disc 26 to printed circuit board 28, it should be appreciated that snap disc 26 may otherwise be held in contact with circuit board 28.

Figure 4:
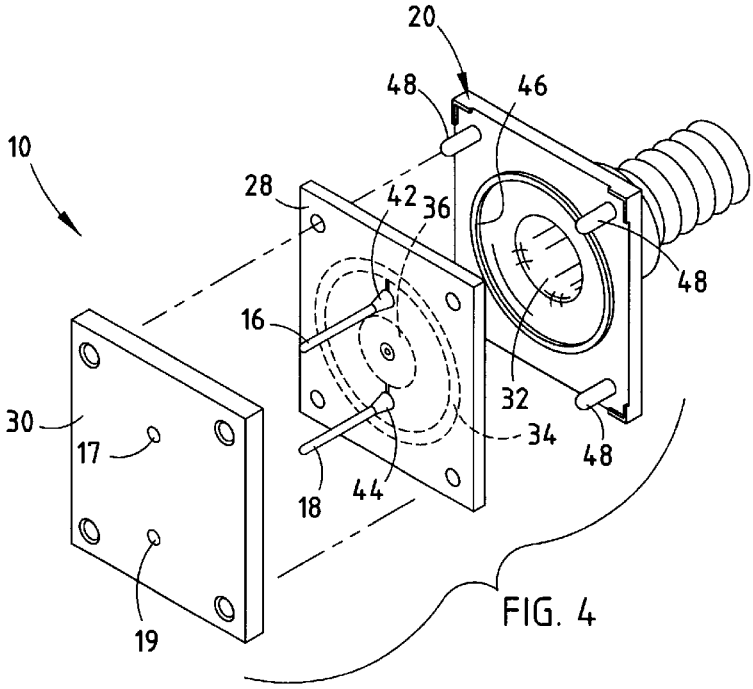
FIG. 4 is a partial exploded view further illustrating electrical connection of first and second terminals to the printed circuit board.

Referring to FIG. 4, the first and second electrical terminals 16 and 18 are shown as conductive pins soldered to the rear surface of the printed circuit board 28 and electrically coupled to the outer and inner printed circuits 34 and 36 by way of conductive vias 38 and 40. Provided at one end of each of terminals 16 and 18 are enlarged diameter feet 42 and 44, respectively. The first and second electrical terminals 16 and 18 extend through respective openings 17 and 19 formed in the rear support member 30 such that the enlarged diameter feet 42 and 44 prevent terminals 16 and 18 from being removed and protect the terminals 16 and 18 against damage by resisting lateral movement thereof. An open or closed electrical circuit path is provided between terminals 16 and 18 depending upon the pressure of the fluid within fluid chamber 32.

Figure 6:
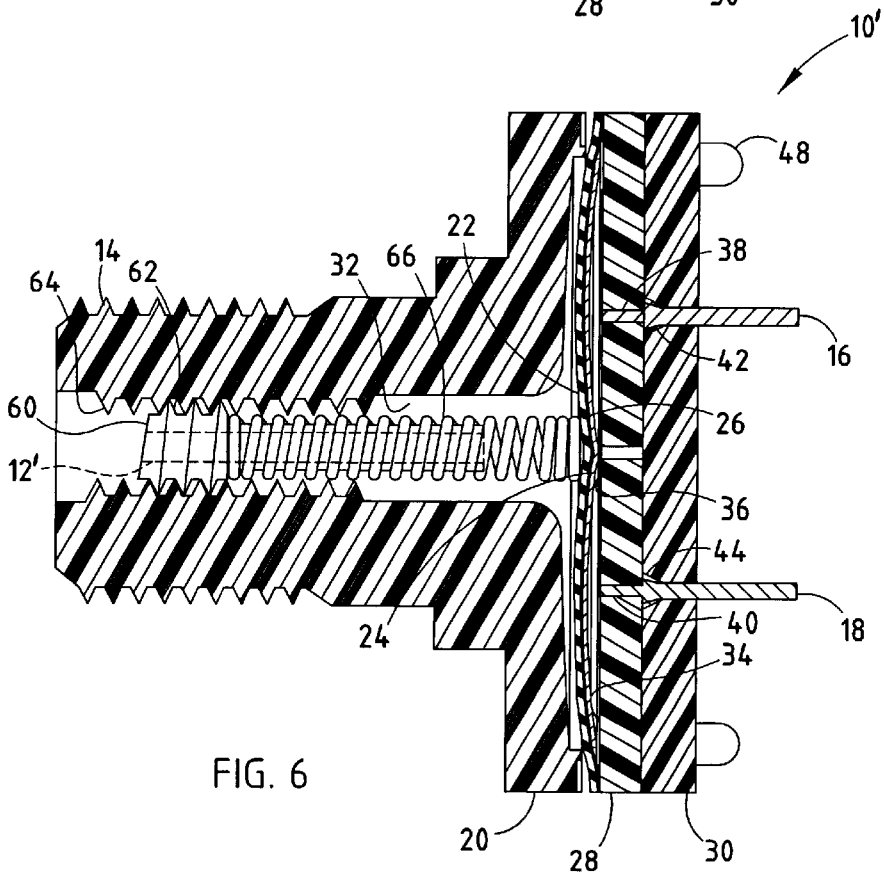
FIG. 6 is a cross-sectional view of a pressure switch configured as a vacuum switch according to a second embodiment of the present invention.
Figure 7:
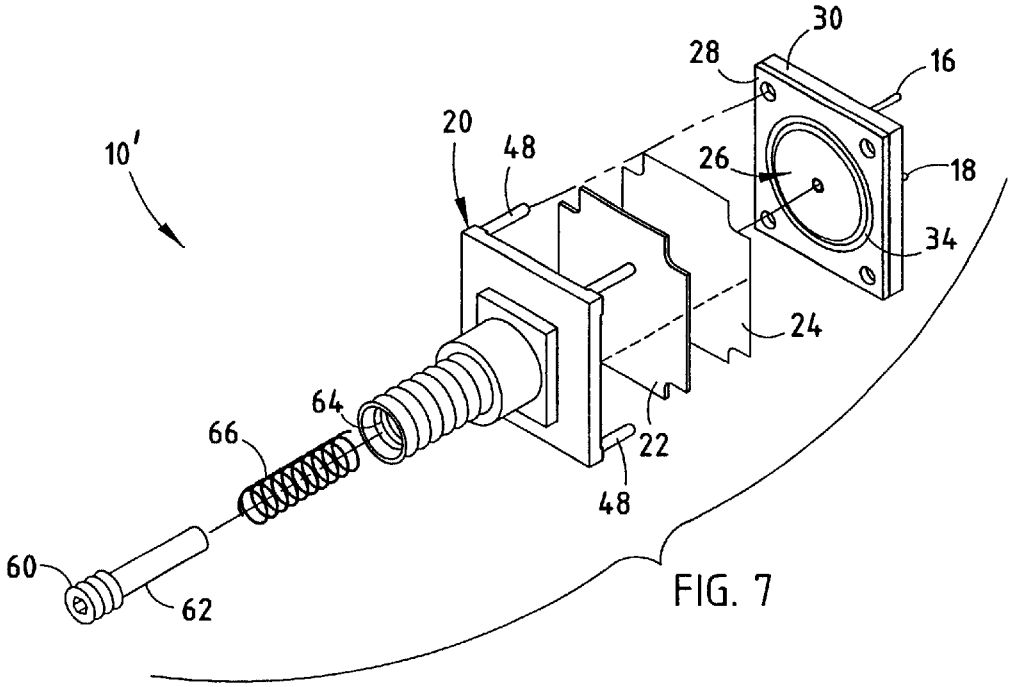
FIG. 7 is an exploded view of the pressure switch shown in FIG. 6.
Figure 8:
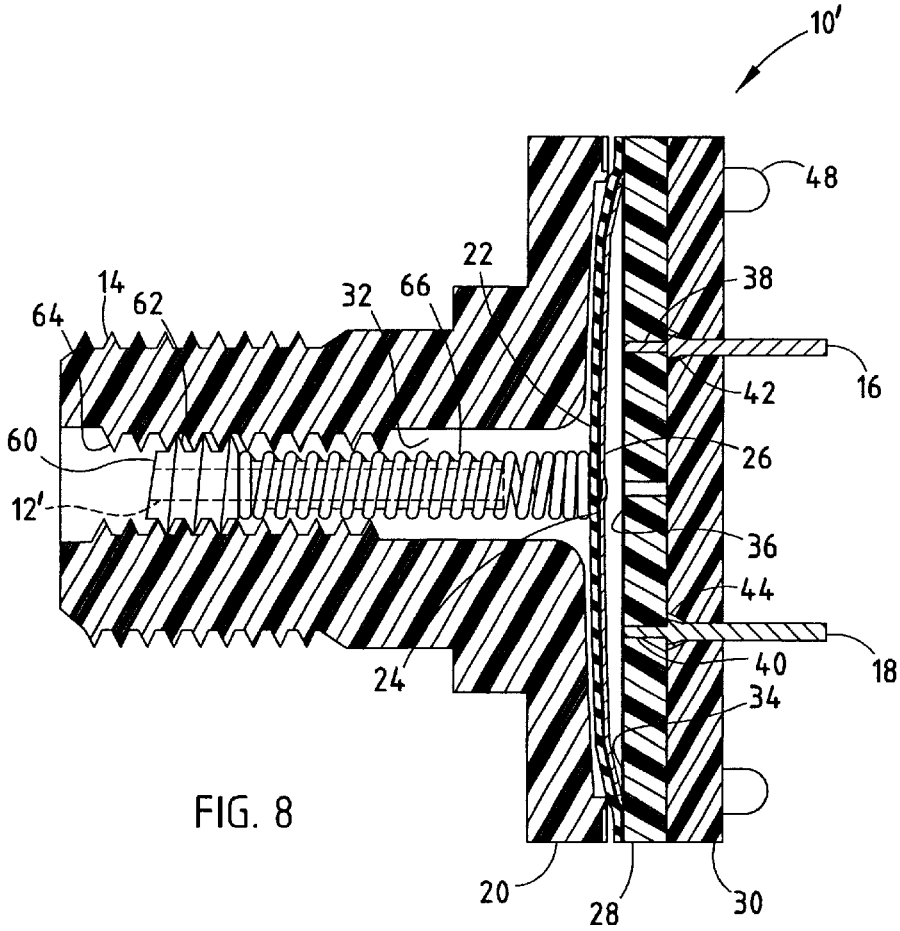
FIG. 8 is a cross-sectional view of the pressure switch shown in FIG. 6 showing the snap disc in an open contact position.

Referring to FIGS. 6–8, a pressure switch 10' is illustrated according to a second embodiment of the present invention. The pressure switch 10' is generally shown including substantially the same components described in connection with the pressure switch 10 of the first embodiment and, therefore, the same reference numerals are used to identify identical features. The pressure switch 10' is shown configured to sense a negative pressure differential such that switch 10' operates as a vacuum switch for sensing a vacuum (i.e., negative pressure) within fluid chamber 32. Pressure switch 10' includes the addition of a coil spring 66 compressed to apply a pretensioning force onto the front surface of snap disc 26. Spring 66 is biased in compression by way of a threaded plug 60 having an outer threaded surface 62 engaging an internal threaded receptacle 64 in fluid housing 20. The plug 60 includes a hollow fluid inlet 12' for allowing fluid to be received within the fluid chamber 32.

According to the second embodiment as shown in FIG. 6, the snap disc 26 is compressed into a first shape to provide a closed contact position such that the electrical circuit path between the first and second terminals 16 and 18 is closed when the fluid vacuum is less than a vacuum set point. Upon sensing a vacuum in fluid chamber 32 in excess of a preset vacuum set point, snap disc 26 will be forced to overcome the spring bias provided by spring 66 and will change configuration to a second shape as shown in FIG. 8 to switch to an open circuit position to thereby open the electrical circuit path between first and second terminals 16 and 18. It should be appreciated that the positioning of plug 60 is adjustable by turning the plug 60 to adjust the amount of pretension force applied by coil spring 66 to snap disc 26 to thereby allow for adjustment of the vacuum set point.

It should further be appreciated that while the pressure switch 10' according to the second embodiment is shown operating as a vacuum switch, the pressure switch 10' could be employed to operate as a pressure switch for sensing positive: pressure differential, instead of a vacuum (negative pressure differential). To do so, the coil spring 66 is adjusted via plug 60 to provide a reduced amount of pretensioning force applied to snap disc 26 such that the snap disc 26 is normally in the open contact position of the second shape as shown in FIG. 8 when fluid pressure in fluid chamber 32 is below a pressure set point. When the fluid pressure within fluid chamber 32 reaches the preset pressure set point, the snap disc 36 is caused to change to the first shape to switch to the closed contact position shown in FIG. 6. By employing the combination of the adjustable plug 60 and spring 66 in a pressure switch 10', the pressure set point may easily be adjusted.

According to one embodiment, the coil spring 66 has a length much larger than the length of travel of the other movable switch components including the snap disc 26. According to one example, the length of spring 66 is at least one hundred times greater than the travel distance of the snap disc 26. Accordingly, the spring 66 has a very limited travel distance relative to its overall length and, thus, is less susceptible to spring deterioration and spring constant variations which may otherwise occur with more extended spring travel.

Accordingly, the pressure switch 10 and 10' of the present invention advantageously provides for a snap disc-type pressure switch employing a minimal number of moving components. The pressure switch 10 and 10' is easy to assemble, is cost affordable, and offers high reliability. In addition, the pressure switch 10' is easily adjustable to enable a user to set the pressure set point.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A pressure switch comprising:

a housing comprising walls defining a fluid chamber to receive a fluid;

a snap disc having a front surface in pressure communication with the fluid chamber and responsive to switch states between first and second shapes based on a pressure set point, said snap disc further having an electrically conductive rear surface; and a circuit board comprising first and second electrical terminals, wherein the electrically conductive rear surface of the snap disc forms a closed circuit between the first and second terminals when in the first shape and forms an open circuit when in the second shape.

2. The pressure switch as defined in claim 1 further comprising a gasket disposed between the fluid chamber and the snap disc for forming a seal between the snap disc and the fluid chamber.

3. The pressure switch as defined in claim 2 further comprising a recessed seat formed in one wall of the fluid chamber to receive the snap disc, wherein the gasket comprises a planar gasket disposed on the front surface of the snap disc.

4. A pressure switch comprising:

a housing comprising walls defining a fluid chamber for receiving a fluid;

a snap disc having a front surface in pressure communication with the fluid chamber and responsive to switch states between first and second shapes based on a pressure set point, said snap disc further having an electrically conductive rear surface;

a spring applying a bias force to one of the front and rear surfaces of the snap disc to pretension the snap disc; and a circuit board comprising first and second electrical terminals, wherein the snap disc forms a closed circuit between the first and second terminals when in the first shape and forms an open circuit when in the second shape.

5. The pressure switch as defined in claim 4 further comprising a spring bias adjustment device for adjusting the pressure set point.

6. The pressure switch as defined in claim 4, wherein the spring applies a bias force to the front surface of the snap disc.

7. The pressure switch as defined in claim 6, wherein the pressure switch is a vacuum switch responsive to provide a switched output signal upon reaching a preset vacuum set point.

8. The pressure switch as defined in claim 1, wherein the snap disc comprises a conductive material.

9. A pressure switch comprising:

a housing comprising walls defining a fluid chamber to receive a fluid;

a snap disc having a front surface in pressure communication with the fluid chamber and responsive to switch states between first and second shapes based on a pressure set point, said snap disc further having an electrically conductive rear surface;

a first electrical terminal; and a second electrical terminal, wherein the first and second electrical terminals form a closed circuit with the conductive rear surface of the snap disc when in a first shape and form an open circuit when in a second shape.

10. The pressure switch as defined in claim 9 further comprising a circuit board having a conductive path to be contacted by the rear surface of the snap disc when in the first shape, wherein the first and second electrical terminals are electrically coupled to the conductive path.

11. The pressure switch as defined in claim 9 further comprising a gasket disposed between the fluid chamber and the snap disc for forming a seal between snap disc and the fluid chamber.

12. The pressure switch as defined in claim 11, wherein the gasket extends over the front surface of the snap disc.

13. The pressure switch as defined in claim 12 further comprising a recessed seat formed in one wall of the fluid chamber to receive the snap disc, wherein the gasket comprises a planar gasket disposed over the front surface of the snap disc.

14. The pressure switch as defined in claim 9 further comprising a spring applying a bias force to one of the front and rear surfaces of the snap disc to pretension the snap disc.

15. The pressure switch as defined in claim 14 further comprising a spring bias adjustment device for adjusting the pressure set point.

16. The pressure switch as defined in claim 14, wherein the spring applies a bias force to the front surface of the snap disc.

17. The pressure switch as defined in claim 16, wherein the pressure switch is a vacuum switch responsive to provide a switched output signal upon reaching a preset vacuum set point.

18. The pressure switch as defined in claim 9, wherein the snap disc comprises a conductive material.

19. A vacuum switch comprising:

a housing comprising walls defining a fluid chamber to receive a fluid;

a snap disc having a front surface in pressure communication with the fluid chamber and responsive to switch states between first and second shapes based on a vacuum set point, said snap disc further having an electrically conductive rear surface;

a spring applying a bias force to the front surface of the snap disc to pretension the snap disc; and a circuit board comprising first and second electrical terminals, wherein the electrically conductive rear surface of the snap disc forms a closed circuit between the first and second terminals when in the first shape and forms an open circuit when in the second shape.

20. The vacuum switch as defined in claim 19 further comprising a gasket disposed between the fluid chamber and the front surface of the snap disc to form a seal between the snap disc and the fluid chamber.

21. The vacuum switch as defined in claim 20 further comprising a recessed seat formed in one wall of the fluid chamber to receive the snap disc, wherein the gasket comprises a planar gasket disposed on the front surface of the snap disc.

22. A vacuum switch comprising:

a housing comprising walls defining a fluid chamber to receive a fluid;

a snap disc having a front surface in pressure communication with the fluid chamber and responsive to switch states between first and second shapes based on a vacuum set point, said snap disc further having an electrically conductive rear surface;

a spring applying a bias force to the front surface of the snap disc to pretension the snap disc;

a spring bias adjustment device for adjusting the vacuum set point; and a circuit board comprising first and second electrical terminals, wherein the snap disc forms a closed circuit between the first and second terminals when in the first shape and forms an open circuit when in the second shape.

23. The vacuum switch as defined in claim 19, wherein the snap disc comprises a conductive material.

* * * * *